US006791432B2

(12) United States Patent
Smith et al.

(10) Patent No.: US 6,791,432 B2
(45) Date of Patent: Sep. 14, 2004

(54) LEFT HANDED COMPOSITE MEDIA

(75) Inventors: David Smith, San Diego, CA (US); Sheldon Schultz, LaJolla, CA (US); Norman Kroll, LaJolla, CA (US); Richard A. Shelby, San Diego, CA (US)

(73) Assignee: The Regents of the University of California, Oakland, CA (US)

( * ) Notice: Subject to any disclaimer, the term of this patent is extended or adjusted under 35 U.S.C. 154(b) by 117 days.

(21) Appl. No.: 09/811,376

(22) Filed: Mar. 16, 2001

(65) Prior Publication Data

US 2001/0038325 A1 Nov. 8, 2001

Related U.S. Application Data

(60) Provisional application No. 60/190,373, filed on Mar. 17, 2000.

(51) Int. Cl.[7] ..... H01P 7/08; H01Q 15/10

(52) U.S. Cl. ..... 333/99 S; 343/909; 333/219

(58) Field of Search ..... 252/582; 333/99 R, 333/99 S, 219; 343/909

(56) References Cited

U.S. PATENT DOCUMENTS 5,635,453 A 6/1997 Pique et al.

OTHER PUBLICATIONS

J.B. Pendry, A.J. Holden, D.J. Robbins, and W.J. Stewart, "*Low frequency plasmons in thin–wire structures*", J. Phys.: Condens. Matter 10 (1998), pp. 4785–4809.

J.B. Pendry, A.J. Holden, W.J. Stewart, and I. Youngs, "*Extremely Low Frequency Plasmons in Metallic Mesostructures*", Physical Review Letters, vol. 76, No. 25, Jun. 17, 1996, pp. 4773–4776.

D.R. Smith, D.C. Vier, Willie Padilla, Syrus C. Nemat-Nasser, and S. Schultz, "*Loop–wire medium for investigating plasmons at microwave frequencies*," Applied Physics Letters, vol. 75, No. 10, Sep. 6, 1999, pp. 1425–1427.

V.G. Veselago, "*The Electrodynamics of Substances with Simultaneously Negative Values of* $\in$ *and* $\mu$", Soviet Physics Uspekhi, vol. 10, No. 4, Jan.–Feb. 1968, pp. 509–514.

J.B. Pendry, A.J. Holden, D.J. Robbins, and W.J. Stewart, "*Magnetism from Conductors and Enhanced Nonlinear Phenomena*," IEEE Transactions on Microwave Theory and Techniques, vol. 47, No. 11, Nov. 1999, pp. 2075–2084.

D.R. Smith, Willie J. Padilla, D.C. Vier, S.C. Nemat–Nasser, S. Schultz, "*A composite medium with simultaneously negative permeability and permittivity*", Preprint Jan. 2000, pp. 1–5.

J.B. Pendry, A.J. Holden, D.J. Robbins, and W.J. Stewart, "*Low frequency plasmons in thin–wire structures*", J. Phys.: Condens. Matter 10 (1998), pp. 4785–4809.

*Primary Examiner*—Benny T. Lee
(74) *Attorney, Agent, or Firm*—Greer, Burns & Crain, Ltd.

(57) ABSTRACT

Composite media having simultaneous negative effective permittivity and permeability over a common band of frequencies. A composite media of the invention combines media, which are either themselves separately composite or continuous media, having a negative permittivity and a negative permeability over a common frequency band. Various forms of separate composite and continuous media may be relied upon in the invention. A preferred composite media includes a periodic array of conducting elements that can behave as an effective medium for electromagnetic scattering when the wavelength is much longer than both the element dimension and lattice spacing. The composite media has an effective permittivity $\epsilon_{eff}(\omega)$ and permeability $\mu_{eff}(\omega)$ which are simultaneously negative over a common set of frequencies. Either one or both of the negative permeability and negative permittivity media used in the invention may be modulable via external or internal stimulus. Additionally, the medium or a portion thereof may contain other media that have medium electromagnetic parameters that can be modulated. The frequency position, bandwidth, and other properties of the left-handed propagation band can then be altered, for example, by an applied field or other stimulus. Another possibility is the use of a substrate which responds to external or internal stimulus.

42 Claims, 6 Drawing Sheets

LEFT HANDED COMPOSITE MEDIA

RELATED APPLICATIONS AND PRIORITY CLAIM

This application is related to prior provisional application serial No. 60/190,373 filed Mar. 17, 2000. This application claims priority from that provisional application under 35 U.S.C. §119(e).

STATEMENT OF GOVERNMENT INTEREST

The invention in this application was made with the assistance of the United States Government under grants from the NSF and DOE: NSF-DMR-96-23949, NSF-DMR-9724535, DOE-DE-FG-03-93ER40793. The Government has certain rights in this invention.

FIELD OF THE INVENTION

The present invention is in the field of electromagnetic media and devices.

BACKGROUND OF THE INVENTION

The behavior of electromagnetic radiation is altered when it interacts with charged particles. Whether these charged particles are free, as in plasmas, nearly free, as in conducting media, or restricted, as in insulating or semiconducting media—the interaction between an electromagnetic field and charged particles will result in a change in one or more of the properties of the electromagnetic radiation. Because of this interaction, media and devices can be produced that generate, detect, amplify, transmit, reflect, steer, or otherwise control electromagnetic radiation for specific purposes. In addition to interacting with charges, electromagnetic waves can also interact with the electron spin and/or nuclear spin magnetic moments. This interaction can be used to make devices that will control electromagnetic radiation. The properties of such media and devices may further be changed or modulated by externally applied static or time-dependent electric and/or magnetic fields. Other ways of producing changes in a medium or device include varying temperature or applied pressure, or allowing interactions with acoustic, ultrasonic, or additional electromagnetic waves (from low frequencies up through the optical). Other changes could be effected by introducing charged particle beams into the device or medium.

When electromagnetic radiation is incident on a medium composed of a collection of either homogenous or heterogeneous scattering entities, the medium is said to respond to the radiation, producing responding fields and currents. The nature of this response at a given set of external or internal variables, e.g., temperature and pressure, is determined by the composition, morphology and geometry of the medium. The response may, in general, be quite complicated. However, when the dimensions and spacing of the individual scattering elements composing the medium are less than the wavelength of the incident radiation, the responding fields and currents can be replaced by macroscopic averages, and the medium treated as if continuous.

The result of this averaging process is to introduce averaged field quantities for the electric and magnetic fields (E and B, respectively), as well as the two additional averaged field quantities H and D. The four field vector quantities are related at each frequency $\omega$ by the relations $B=\mu(\omega)H$ and $D=\epsilon(\omega)E$, where $\epsilon(\omega)$ represents the medium parameter known as electrical permittivity, and $\mu(\omega)$ represents the magnetic permeability. Wave propagation within a continuous medium is characterized by the properties of the medium parameters. A continuous medium is one whose electromagnetic properties can be characterized by medium parameters that vary on a scale much larger than the dimension and spacing of the constituent components that comprise the medium. At an interface between a first continuous medium and a second continuous medium, wave propagation is characterized by both the medium parameters of the first continuous medium as well as the medium parameters of the second continuous medium. The medium parameters may have further dependencies, such as on frequency or direction of wave propagation, and may also exhibit non-linear response. There are limitations on the nature of $\mu(\omega)$ and $\epsilon(\omega)$ that must be consistent with known physical laws; but many forms, such as tensor representation, can occur in practice.

Naturally occurring media-those media either typically found in nature, or that can be formed by known chemical synthesis—exhibit a broad, but nonetheless limited, range of electromagnetic response. In particular, magnetic effects are generally associated with inherently magnetic media, whose response falls off rapidly at higher frequencies. It is thus difficult to find media with significant permeability at RF and higher frequencies. Furthermore, media that possess the important property of negative permeability are very rare, and have only been observed under laboratory conditions in specialized experiments. In contrast, many metals exhibit a negative permittivity at optical frequencies, but other media exhibiting values of negative permittivity at optical or lower frequencies (GHz, for example) are not readily available.

The averaging process that leads to the determination of medium parameters in naturally occurring media, where the scattering entities are atoms and molecules, can also be applied to composite media—media formed by physically combining, mixing, or structuring two or more naturally occurring media, such that the scale of spatial variation from one medium to the next is less than the range of wavelengths of the electromagnetic radiation over which the resulting medium is to be utilized. In many composite media, macroscopic scattering elements replace microscopic atoms and molecules; yet the resulting composite can be considered a continuous medium with respect to electromagnetic radiation, so long as the average dimension and spacing are less than a wavelength.

Nearly all practical naturally occurring and composite media have a permittivity and permeability both greater than zero, and generally equal to or greater than unity, at typical frequencies of interest. Such media are considered transparent if the inherent losses (imaginary parts of the permittivity or permeability) are sufficiently small. In transparent media, electromagnetic fields have the form of propagating electromagnetic waves, although the small amount of damping present may lead to absorption of a portion of the electromagnetic energy. If either the permittivity or the permeability is negative, but not both, then electromagnetic fields are non-propagating, and decay exponentially into the medium; such a medium is said to be opaque to incident radiation provided its thickness is greater than the characteristic exponential decay length. A familiar and pertinent example of a medium that can be either opaque or transparent depending on the frequency of excitation is given by a dilute plasma, which has a frequency dependent permittivity given by $$\varepsilon(\omega) = 1 - \frac{\omega_p^2}{\omega^2} \quad (1)$$

where $\omega_p$ is a parameter dependent on the density, charge, and mass of the charge carrier; this parameter is commonly known as the plasma frequency. For this illustration, $\mu$ is assumed to be unity for all frequencies. Below the plasma frequency, the permittivity is negative, and electromagnetic waves cannot propagate; the medium is opaque. Above the plasma frequency, the permittivity is positive, and electromagnetic waves can propagate through the medium. A familiar example of a dilute plasma is the earth's ionosphere, from which low-frequency radiation is reflected (when $\epsilon(\omega) < 0$), but which transmits high-frequency radiation.

A wave propagating in the z-direction through a medium has the form $\exp[in(\omega)\omega z/c - i\omega t]$, where i is the square root of −1, and $n^2(\underline{\omega}) = \epsilon(\omega)\mu(\omega)$. A plane wave thus oscillates with time and position whenever the product $\epsilon(\omega)\mu(\omega)$ is positive, and decays exponentially whenever the product $\epsilon(\omega)\mu(\omega)$ is negative. For transparent media, the product is positive and waves propagate.

Composite or naturally occurring media in which both $\epsilon(\omega)$) and $\mu(\omega)$ are simultaneously negative have not been previously known. If both $\epsilon(\omega)$ and $\mu(\omega)$ are simultaneously negative, the product $\epsilon(\omega)\mu(\omega)$ is once again positive, and electromagnetic waves propagate. Thus, the square root is a real quantity, raising the question of whether electromagnetic waves can propagate in such a medium. Since only the product $\epsilon(\omega)\mu(\omega)$ enters into the form of a plane wave, it at first appears that there is no difference between a medium where both $\epsilon(\omega)$ and $\mu(\omega)$ are simultaneously positive and a medium where both $\epsilon(\omega)$ and $\mu(\omega)$ are simultaneously negative.

In 1968, Veselago theoretically considered the properties of a medium in which both $\epsilon(\omega)$ and $\mu(\omega)$ were assumed to be simultaneously negative, by examining the solutions of Maxwell's equations. Even though Veselago noted that such a medium was nonexistent at the time, he pointed out that the existence of such media was not ruled out by Maxwell's equations, and presented a theoretical analysis of the manner in which electromagnetic waves would propagate. See, V. G. Veselago, *Soviet Physics* USPEKHI 10, 509 (1968). Veselago concluded that wave propagation in a medium with simultaneously negative $\epsilon(\omega)$ and $\mu(\omega)$ would exhibit remarkably different properties than media in which $\epsilon(\omega)$ and $\mu(\omega)$ are both positive.

In usual media, when both $\epsilon(\omega)$ and $\mu(\omega)$ are simultaneously positive, the direction of the energy flow, and the direction of the phase velocity (or wavevector k) are in the same direction of E×H. We term such a medium right-handed. When $\epsilon(\omega)$ and $\mu(\omega)$ are both negative, the direction of the phase velocity, given by E×B, is opposite to the direction of energy flow, given by E×H, as $H = B/\mu$. The directions of the field vectors E and H, and the direction of the propagation wavevector k thus form a left-handed coordinate system, and Veselago termed media with simultaneously negative $\epsilon(\omega)$ and $\mu(\omega)$ left-handed media (LHM). Furthermore, Veselago suggested that the correct index-of-refraction $n(\omega)$ to be used in the interpretation of Maxwell's equations should be taken as the negative square root of the product $\epsilon(\omega)\mu(\omega)$, and thus that left-handed media could be equivalently referred to as negative refractive index media. The property of negative refractive index holds profound consequences for the optics associated with left-handed media, and Veselago pointed out several examples of how geometrical optics would be altered for lenses and other objects composed of left-handed media. For example, a converging lens made of left-handed medium would actually act as a diverging lens, and a diverging lens made of left-handed medium would actually act as a converging lens. Also, the rays emanating from a point source next to a planar slab of LHM could, given the correct geometry and value of index-of-refraction, be brought to a focus on the other side of the slab.

Veselago predicted a number of electromagnetic phenomena that would occur in a LHM, including reversed refraction, reversal of the Doppler shift and Cerenkov radiation, and the reversal of radiation pressure. These phenomena were not demonstrable by Veselago due to the lack of a physical realization of a left-handed medium.

SUMMARY OF THE INVENTION

The invention concerns composite media having simultaneous negative effective permittivity and permeability over a common band of frequencies. A composite medium of the invention combines media, which are either themselves separately composite or continuous media, each having a negative permittivity and a negative permeability over at least one common frequency band. Various forms of separate composite and continuous media may be relied upon in the invention.

In a preferred embodiment, one or both of the negative permeability and negative permittivity media used in the composite medium of the invention may be modulated via stimuli. Additionally, the medium or a portion thereof may contain other media that have medium electromagnetic parameters that can be modulated. The frequency position, bandwidth, and other properties of the left-handed propagation band can then be altered from within or without, for example, by an applied field or other stimulus. This modulation could result, for example, in a composite medium that may be switched between left-handed and right-handed properties, or between transparent (left-handed) and opaque (non-propagating) over at least one band of frequencies. In addition, in a left-handed medium of the invention it may be useful to introduce an intentional defect, e.g., a right handed element or set of elements to act as a scattering "defect" within the medium. More than one defect or arrays of defects may also be introduced.

A preferred composite media includes a periodic array of conducting elements that can behave as a continuous medium for electromagnetic scattering when the wavelength is sufficiently longer than both the element dimension and lattice. The preferred composite medium has an effective permittivity $\epsilon_{eff}(\omega)$ and an effective permeability $\mu_{eff}(\omega)$ which are simultaneously negative over a common band of frequencies.

BRIEF DESCRIPTION OF THE DRAWINGS

Other features, objects and advantages of the invention will be apparent to those skilled in the art from the detailed description and figures, of which:

FIG. 2(*b*) is a resonance curve for the split ring resonator of FIG. 2;

FIG. 3(*b*) illustrate a dispersion curve for a split ring resonator for a perpendicular polarization;

FIG. 3(*c*) illustrates the effect of a conducting wire on the parallel polarization of FIG. 3(*a*);

FIG. 3(*d*) illustrates the effect of a conducting wire on the perpendicular polarization of FIG. 3(*b*);

FIG. 5(*b*) illustrates a single unit structure for an alternate embodiment of the invention;

DETAILED DESCRIPTION OF THE PREFERRED EMBODIMENTS

Figure 1:
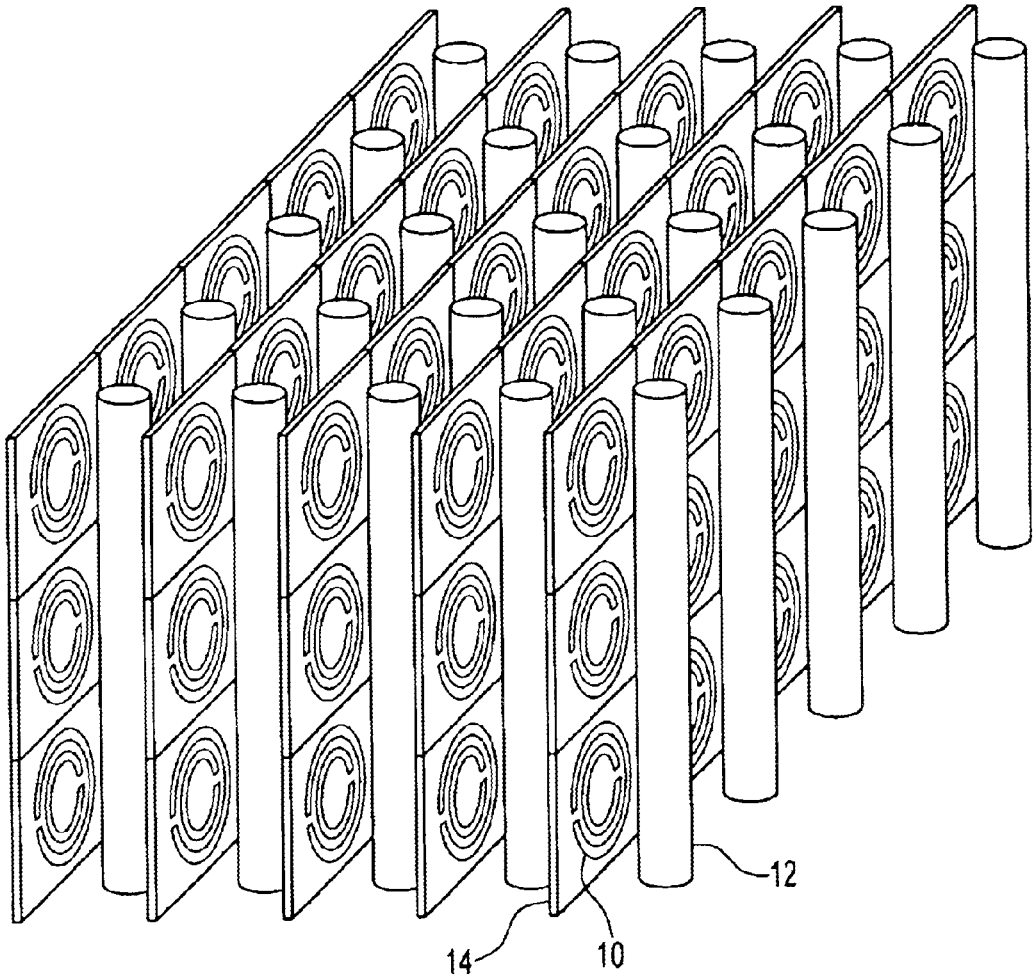
FIG. 1 shows a preferred embodiment left-handed composite medium of the invention.

While naturally occurring media have not been demonstrated that can by themselves provide the appropriate medium properties necessary for a left-handed medium, the invention combines either naturally occurring or composite media in such a manner as to result in composite left-handed media. Composite media have permeability and permittivity properties termed "effective." However, the averaging procedure used to determine the effective medium parameters for a composite structure is the same as that used to determine the medium parameters for naturally occurring media. Thus, from an electromagnetic point of view, a composite structure is equivalent to a continuous medium over a restricted band of frequencies.

The present invention of a left handed composite medium requires the combination of media that can give rise to simultaneously negative medium parameters. Others have produced composite media having either a negative permittivity or a negative permeability, but not both. These previously produced composite media may be used in the invention. Some specific examples are now discussed, while artisans will be able to practice the invention using other media through the guidance provided by the examples, the preferred embodiments and the additional descriptions found herein.

Composite media characterized by a frequency-dependent permittivity having the same form as a dilute plasma (Equation 1) were developed early on for a variety of scientific and practical applications (R. N. Bracewell, *Wireless Engineer,* 320, 1954; W. Rotman, *IRE Trans. Ant. Prop.,* AP10, 82, 1962). In these media, which consisted of periodic arrangements of metal elements such as rods, wires, or spheres, the plasma frequency was shown to have a value related to the inductance per unit cell. Since the inductance is related to geometrical parameters, by varying the geometry of the scattering elements, the plasma frequency could be designed to have very low values, even in the microwave or radio wave region. This low plasma frequency is advantageous, as composite media with moderately negative values of the permittivity can be fabricated for applications at the low frequency. Practical applications of these composite enhanced permittivity media included microwave lenses, beam steering elements, and prisms.

In recent work (Pendry et al., *Phys. Rev. Lett.,* 76, 4773, 1996) Pendry et al. revisited, theoretically and numerically, a negative permittivity lattice of thin conducting wires, where the radius of a wire (r) was taken on the order of a micron, and the lattice spacing (d) on the order of several millimeters. Analysis showed that, for the parameters selected, the effective plasma frequency $\omega_p$ could be given by $$\omega_p^2 = 2\pi \frac{c^2}{d^2 \ln(d/r)} \tag{2}$$

where c is the speed of light in vacuum. In subsequent work, Pendry et al. provided experiments and more extensive calculations demonstrating that the thin wire structure was well characterized by the permittivity of Equation (1), with the plasma frequency as derived by Equation (2).

The purpose of utilizing wires thin in comparison to their spacing is to bring the plasma frequency below the diffraction frequency, which occurs when the wavelength is on the order of the lattice spacing. Other methods may also be used to reduce the plasma frequency. As an example, introducing loops into the wire lengths will reduce the plasma frequency since the plasma frequency is related inversely to the inductance per unit length in the structure (Smith et al., *Appl. Phys. Lett.,* 75, 10, 1999). If it is not necessary to distinguish the plasma frequency from the diffraction (or Bragg) frequency, the wires need not be thin in any sense.

Merkel (U.S. Pat. No. 3,959,796) introduced a composite medium ". . . comprising a random distribution of inductively-loaded short dipoles for simulating the macroscopic electromagnetic properties of a simple Lorentz plasma." Merkel's structure exhibited a similar permittivity function as the thin wire structure. Pendry et al. (*J. Phys.: Condens. Matter,* 10, 4785, 1998) showed that by breaking the electrical continuity of wires, capacitance is introduced into the structure, resulting in an electrical resonance occurring. The general form of the permittivity for an inductive structure in which electrical continuity is not maintained is then $$\varepsilon(\omega) = 1 - \frac{\omega_p^2}{\omega^2 - \omega_{e0}^2}. \tag{3}$$

As it is possible to design composite media that exhibit enhanced electric response to electromagnetic fields, it is also possible to design composite media that exhibit enhanced magnetic response to electromagnetic fields. While it is of course possible to employ inherently magnetic media for this purpose (i.e., media whose magnetic properties result from the spin rather than classical currents), such media are best suited for lower or zero frequency applications, as these effects tend to tail off with frequency. Also, the range of values for the permeability corresponding to naturally occurring magnetic media (e.g., ferromagnets, ferrimagnets or antiferromagnets) is found empirically to be typically limited to positive values. Furthermore, the presence of static magnetic fields is often required, which can perturb the sample and, for example, potentially make isotropic response difficult to obtain.

Because of the difficulties associated with inherently magnetic media, it is convenient to utilize non-magnetic media to achieve an effective magnetic response. Structures in which local currents are generated that flow so as to produce solenoidal currents in response to applied electromagnetic fields, can produce the same response as would occur in magnetic media, but at much higher frequencies. Generally, any element that includes a non-continuous conducting path nearly enclosing a finite area, and further introduces capacitance into the circuit by some means, will have solenoidal currents induced when a time-varying magnetic field is applied parallel to the axis of the circuit. We term such an element a solenoidal resonator, as such an element will possess at least one resonance at a frequency $\omega_{m0}$ determined by the introduced capacitance and the inductance associated with the current path. Solenoidal currents are responsible for the responding magnetic fields, and thus solenoidal resonators are equivalent to magnetic scatterers. A simple example of a solenoidal resonator is ring of wire, broken at some point so that the two ends come close but do not touch, and in which capacitance has been increased by extending the ends to resemble a parallel plate capacitor. A composite medium composed of solenoidal resonators, spaced closely so that the resonators couple magnetically, exhibits an effective permeability. Such a composite medium was described in the text by I. S. Schelkunoff and H. T. Friis, *Antennas: Theory and Practice*, Ed. S. Sokolnikoff (John Wiley & Sons, New York, 1952), in which the generic form of the permeability (in the absence of resistive losses) was derived as $$\mu(\omega) = 1 - \frac{\omega_{mp}^2}{\omega^2 - \omega_{m0}^2}. \tag{4}$$

Provided that the resistive losses are low enough, Equation 4 indicates that a region of negative permeability should be obtainable, extending from $\omega_{m0}$ to $(\omega_{mp}+\omega_{m0})$.

In 1999, Pendry et al revisited the concept of magnetic composite structures, and presented several methods by which capacitance could be conveniently introduced into solenoidal resonators to produce the magnetic response (Pendry et al., *Magnetism from Conductors and Enhanced Nonlinear Phenomena*, IEEE Transactions on Microwave Theory and Techniques, Vol. 47, No. 11, pp. 2075–84, Nov. 11, 1999; see also PCT application). Pendry et al. suggested two specific elements that would lead to composite magnetic media. The first was a two-dimensionally periodic array of "Swiss rolls," or conducting sheets, infinite along one axis, and wound into rolls with insulation between each layer. The second was an array of double split rings, in which two concentric planar split rings formed the resonant elements. Pendry et al. proposed that the latter medium could be formed into two-and three-dimensionally isotropic structures, by increasing the number and orientation of double split rings within a unit cell.

Pendry et al. used an analytical effective medium theory to derive the form of the permeability for their composite structures. This theory indicated that the permeability should follow the form of Equation (4), which predicts very large positive values of the permeability at frequencies near but below the resonant frequency, and very large negative values of the permeability at frequencies near but just above the resonant frequency, $\omega_{m0}$.

All such and similar composite media provide the possibility of use in a composite left-handed medium of the invention. A continuous medium with negative permeability is also possible to use. For example, although rare, negative $\mu_{eff}(\omega)$ has also been shown to be possible in naturally occurring media when a polariton resonance exists in the permeability, such as in $MnF_2$ and $FeF_2$, or certain insulating ferromagnets and antiferromagnets (D. L. Mills, E. Burstein, *Rep. Prog. Phys.,* 37, 817, 1974). Under the appropriate conditions of frequency and applied magnetic field resonances associated with these media produce negative values of the permeability. These and other forms of negative permeability may be used in the invention, which is directed to combinations of media, composite or continuous, to form a composite medium having simultaneous negative permeability and permittivity over at least one band of frequencies.

Artisans considering the above examples will appreciate that there may be numerous ways in which to arrive at a medium in which one (but not both) of the medium parameters have values less than zero, by using either a suitable naturally occurring medium, or by fabricating composite medium. If a first medium is shown or anticipated to have a region of negative permittivity, and a second medium is shown or anticipated to have a region of negative permeability, then the combination of the two said media may, but not necessarily, produce a left-handed medium (LHM). It is possible, for example, that the two media might interact in an undesired manner, such that the effective medium parameters of the composite are not predicted by assuming the permittivity of the first medium and the permeability of the second medium. It must be determined by either simulation or experiment whether or not a medium composed of two distinct media, one with negative permittivity and one with negative permeability, possesses a left-handed propagation band. This can be accomplished, for example, by careful transmission measurements on the composite sample, in which the phase and amplitude of the transmitted and reflected waves are recorded as a function of frequency, and used to determine the values of $\mu(\omega)'$, $\mu(\omega)''$, $\epsilon(\omega)'$, and $\epsilon(\omega)''$ Since the permeability and permittivity are complex quantities, four separate functions are required to completely specify the medium parameters as a function of frequency. This type of test is commonly referred to in engineering literature as an "S-parameters" test.

While an S-parameters test is a useful method of characterizing the electromagnetic properties of a medium, a sufficient test to determine if the combination of two media has resulted in a LHM is to measure the transmission of electromagnetic waves through either medium separately, and the transmission of electromagnetic waves through the composite. The transmission measurement test is the preferred method for designing and characterizing an LHM.

If electromagnetic waves are incident on a sample composed of a medium having a frequency band where either the permittivity or the permeability is negative (but not both), the sample is opaque and the incident waves are rejected from the sample leading to attenuation of the transmitted power. For a thick enough sample, a transmission "stop band" will be apparent for frequency bands where one of the medium parameters is negative.

If a new composite medium can be made where the negative permittivity frequency band of the first medium has some overlap with the negative permeability frequency band of the second medium, then a transmission measurement through a thick sample should produce a transmission band in that frequency band rather than the attenuation region corresponding to either medium alone. If there is no transmission band present, then the combination of media will have resulted in an undesired interaction, and the medium electromagnetic parameters of the composite may not be easily related to the medium electromagnetic parameters of either medium alone.

In order to best achieve a LHM, it is desirable to combine two media together, the first having primarily an electric response to incident radiation and the second having primarily a magnetic response to incident radiation. The selected medium should have a frequency band where its medium electromagnetic parameter is negative. An electric medium thus has a frequency band over which the permittivity is negative, and a magnetic medium has a frequency band over which the permeability is negative. In this manner, the two media are less likely to produce undesired interactions when combined. The electromagnetic properties of either the electric or the magnetic medium alone may be determined by experiment or simulation, and may be purposefully designed to optimize frequency location, bandwidth, dispersion characteristics and other figures of merit where the dominant medium parameter is negative.

It will be appreciated that there are many naturally occurring or composite media whose electric properties over a band of frequencies are best characterized by a negative permittivity. It will also be appreciated that while they are less obvious, there are also naturally occurring or composite media whose magnetic properties over a band of frequencies can be best characterized by a negative permeability. The combination of an electric medium and a magnetic medium is capable, in principle, of yielding a LHM. The following set of examples in no way exhausts the possibilities methods of creating LHMs, but presents some practical implementations from which those skilled in the art will be able to understand and use LHM through the teaching of the invention.

The LHM can be built up as a physically constructed composite, the combination of an electric medium and a magnetic medium. The electric and magnetic media, considered separately, are most simply visualized as comprised of identical units (or cells). Within at least some of the units are located one or more elements designed to contribute to a negative permittivity or a negative permeability. Each element may represent either a portion of continuous medium, plasma, or a scattering object. The size of the unit is preferably significantly smaller than the wavelength of the applied electromagnetic radiation, as it is for these dimensions that bulk effective medium parameters are most properly applied. The LHM can then be understood as a combination of units, some units being composed of the electric medium, and other units being composed of the magnetic medium. This model is conceptual, as the units may be entirely composed of a continuous medium, in which case the division into units is arbitrary. In the resulting medium, the new composite unit may encompass the element, or the medium, of the electric medium as well as the element, or the medium, of the magnetic medium.

When the media are combined, it is reasonable to assume that there will be other media present that facilitate the assembly of the composite, but do not necessarily contribute toward the left-handed electromagnetic properties of the composite. These media or other elements are termed the "substrate."

In one preferred embodiment, the electric and magnetic units are periodically distributed, although within each unit the effective permittivity or permeability may be anisotropic, resulting in a medium in which the left-handed frequency band occurs only for one or two propagation directions. The spatial distributions of the units may include fractal, pseudorandom, random, or many other types. Either one or both of the negative permeability and negative permittivity media used in the composite medium of the invention may be modulated via external or internal stimulus. Thus, the composite medium may be switched between left-handed and right-handed properties, or between transparent (left-handed) and opaque (non-propagating) over at least one band of frequencies. Such switching is the extreme case, with lesser modulations to change values of permittivity or permeability within the positive and negative range also being useful. Another possibility is the use of a substrate which responds to external or internal stimulus. A substrate that includes a piezoelectric material may serve to modulate the physical size of the substrate by a locally applied electric field. A substrate or element component incorporating magnetostrictive material may serve also to modulate the physical size of the substrate by an applied magnetic field. Additionally, the medium or a portion thereof may contain other media that have medium electromagnetic parameters that can be modulated. For example, a portion of the medium may be modulated by diverse resonance excitation such as NMR ("Nuclear Magnetic Resonance"), EPR ("Electron Paramagnetic Resonance"), CESR (Conduction Electron Spin Resonance"), AFR ("Adiabatic Fountain Resonance"), FMR ("Functional Magnetic Resonance"), and paraelectric resonance. Additionally, media used may be photomodulated. The frequency position, bandwidth, and other properties of the left-handed propagation band can then be altered, for example, by an applied field or other stimulus.

One purpose of modulation includes the goal of achieving control or stabilization, or tuning sample properties. Methods of varying or controlling temperature, for example, could be to utilize heating currents in the wires themselves. Application of additional RF, or even optical frequencies, could introduce temperature changes in parts or all of the sample.

One method for establishing or modulating permittivity is to use a gas plasma as the medium. The plasma frequency of Equation 1 corresponds to a resonance of the electrons in the plasma. In addition, it is possible to have a second resonant response of a plasma containing ions which are free to move. Ions, having a much larger mass than electrons, have a much lower plasma frequency. Through control of the current, applied electric field or applied magnetic field or gas density, the permittivity of a gas plasma in its value, including a change from negative to positive value. The gas plasma may be contained in tubes or sheets. A change of the magnetic permeability of a medium can occur from media comprised of a ferromagnetic, ferromagnetic, or anti-ferromagnetic medium. Such changes could be accomplished by an applied magnetic field.

In addition, in a left-handed medium of the invention it may be useful to introduce an intentional defect comprised of any configuration of any material which differs from that of the surrounding medium. An example of a defect within a left-handed medium could be a portion of negative permittivity, or negative permeability, or right handed material less than a wavelength. More than one defect or arrays of defects may also be introduced.

A left-handed medium of the invention may include a continuous medium, or a fabricated element designed to give rise to a composite medium when all such units are considered as a collective medium. These elements may be fabricated by any of the many forms of machining, electroless- or electro-plating, direct write process, lithography, multi-media deposition build-up, self-organized assembly, and so forth. Examples of elements include, but are not limited to, a length of conducting wire, a wire with a loop (or loops) along its length, a coil of wire, or several wires or wires with loops. Further examples include those based on solenoidal resonators. A practical example of a solenoidal resonator is provided in I. S. Schelkunoff and H. T. Friis, *Antennas: Theory and Practice,* Ed. S. Sokolnikoff (John Wiley & Sons, New York, 1952). Further examples were recently introduced by Pendry et al. (IEEE Transactions on Microwave Theory and Techniques, Vol. 47, No. 11, pp. 2075–84, Nov. 11, 1999), and include the "G" structure, double split ring resonators, Swiss roll structures, and planar spirals.

The conducting elements described in the preceding paragraph are not restricted solely to metal conductors. Indeed it may be advantageous to use diverse methods of fabrication discussed to deposit conducting elements in the desired geometries, sizes and position, where the conducting material may be composed of optically transparent, such as indium-tin oxide, or other types of "wires" such as conducting polymers, carbon nanotubes, and biomolecular polymers such as DNA, which conduct charge to a sufficient degree.

As describe above, it may be necessary to suspend or support the elements that are desired to produce the left-handed properties on other media termed the substrate. These media will then enter geometrically and electromagnetically into the unit, even though they may not be required to produce the left-handed properties. Examples of substrates include, but are not limited to, plastics; fiberglass; semiconducting media; insulating media, such as quartz ($SiO_2$), sapphire ($Al_2O_3$), or glass; or other composites. Substrates may also act as containers for elements comprised of liquids, gases, and/or plasmas. Substrates may further include other gasses, vacuum, plastics and epoxies, neutral gas plasmas, insulating chemicals, compounds or composite media. In addition to the substrates and elements, the remaining space may be partially or totally filled with a choice of host media. These host media may be chosen for a variety of functions and functionality, including providing absorption and dissipation of the electromagnetic waves, strength of the medium, to make a purposeful choice of design for the permittivity or permeability, or as a means of introducing other functional components, such as capacitors and inductors, or other active components, such as amplifiers, oscillators, antennas, or the like.

A preferred embodiment of the invention utilizes a medium of double split ring resonators to form a magnetic medium (having a frequency band with negative permeability) and a composite wire medium (having a frequency band with negative permittivity). This embodiment forms the primary basis for exemplifying the ideal of the invention, which is a combination of a first composite or continuous medium having an effective permeability for a frequency band which is negative, with a second composite or continuous medium having an effective permittivity over a frequency band which is negative, and wherein the two frequencies regions have a region of overlap. The preferred embodiment system illustrates necessary principles concerning production of a medium of the invention. The exemplary embodiment presented here in FIG. 1 is anisotropic to simplify the analysis, having left-handed properties in only one direction of propagation.

In the preferred embodiment shown in FIG. 1, two composite media are combined to form a LHM. The negative permeability medium of the invention is formed from an array of solenoidal resonators 10, each solenoidal resonator 10 having a dimension much smaller than the wavelength over which it responds resonantly. The preferred embodiment of FIG. 1 uses Pendry's double split ring resonators medium (SRRs) to create a negative permeability medium. The negative pemittivity medium results from the interwoven array of conducting wires 12. A supporting structure of dielectric medium 14 acts as a substrate to arrange the wires and SRRs 10.

Figure 2A:
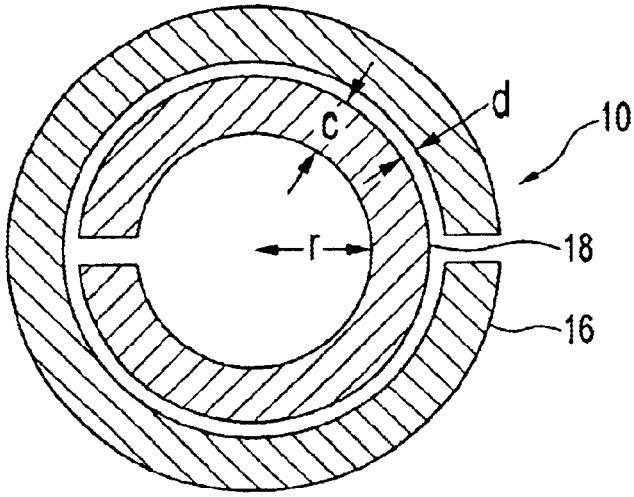
FIG. 2(*a*) shows a split ring resonator of the type used in the FIG. 1 embodiment.
Figure 2B:
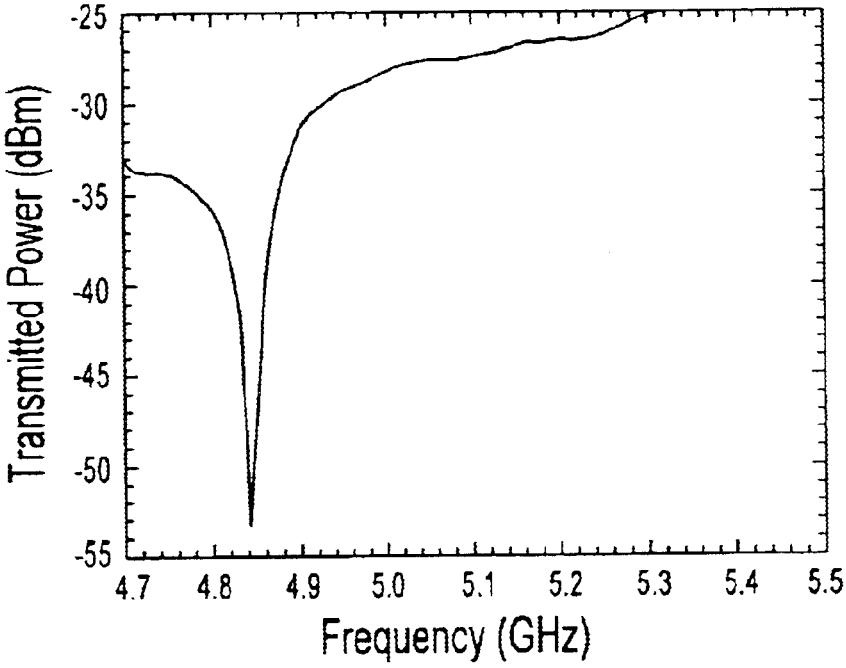
Figure 3A:
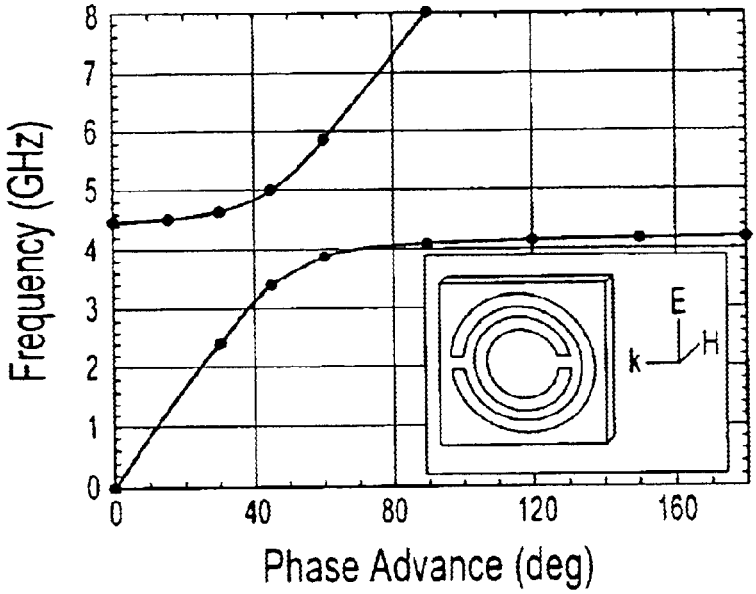
FIG. 3(*a*) illustrates a dispersion curve for a split ring resonator for a parallel polarization.
Figure 3B:
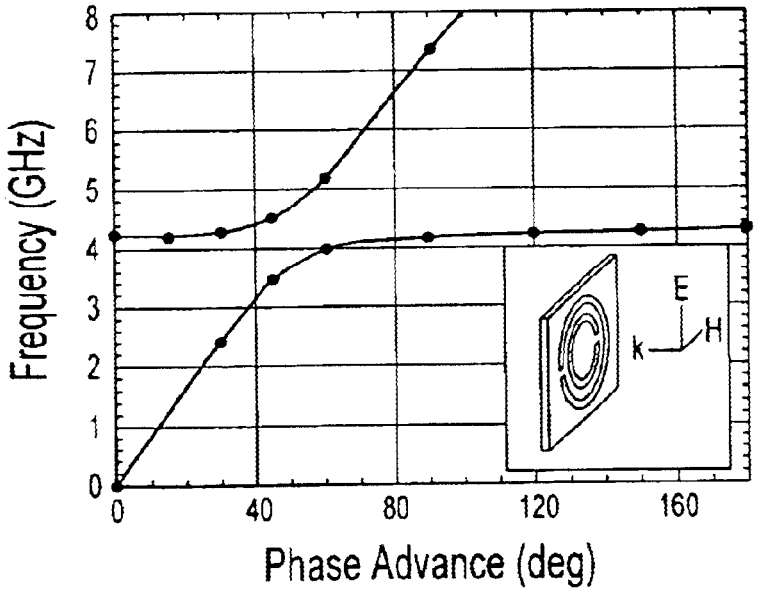
Figure 3C:
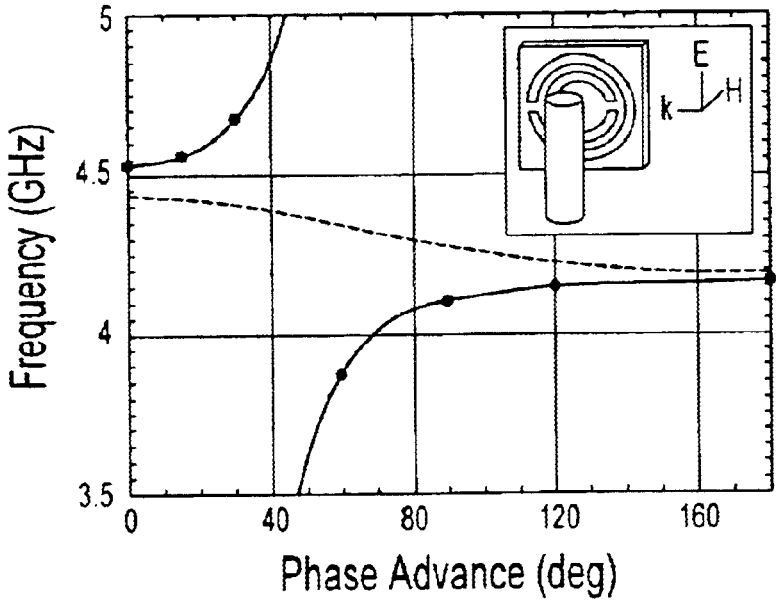
Figure 3D:
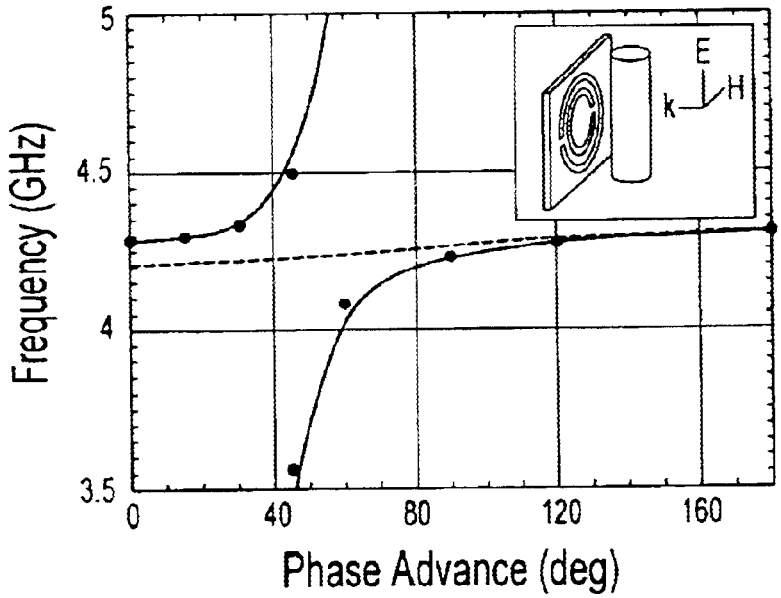

A single SRR 10 is shown in FIG. 2(*a*). The SRR includes concentric split rings 16 and 18 of nonmagnetic (copper) medium. The lattice parameter is a=8.1 mm, c=0.8 mm, d=0.2 mm and r=1.5 mm. A time varying magnetic field applied parallel to the axis of the rings induces currents that, depending on the frequency and the resonant properties of the unit, produce a magnetic field that may either oppose or enhance the incident field. Calculations on the modes associated with SRRs 10 show that the associated magnetic field pattern from an SRR largely resembles that associated with a magnetic dipole. The splits in the rings of the SRR allow the element to be resonant at wavelengths much larger than the diameter of the rings. The purpose of the second split ring 18, inside and whose split is oriented opposite to the first ring 16, is to increase the capacitance in the element, concentrating electric field within the small gap region between the rings and lowering the resonant frequency considerably. The individual SRR shown in FIG. 2(*a*) has its resonance peak at 4.845 GHz. The corresponding resonance curve is shown in FIG. 2(*b*). Because the dimensions of an element are so much smaller than the free space wavelength, the radiative losses are small, and the Q is relatively large (>600 in the case above, as found by microwave measurements as well as numerical simulation).

By combining the split ring resonators into a periodic medium such that there is sufficient (magnetic) coupling between the resonators, unique properties emerge from the composite. In particular, because these resonators respond to the incident magnetic field, the composite medium can be viewed as having an effective permeability, $\mu_{eff}(\omega)$. The general form of the permeability has been presented above (Equation 4); however, the geometry-specific form of the effective permeability was studied by Pendry et al., where the following expression was derived:

$$\mu_{eff} = 1 - \frac{\frac{\pi r^2}{a^2}}{1 - \frac{3l}{\pi^2 \mu_0 \omega^2 C r^3} + i\frac{2l\rho}{\omega r \mu_0}} = 1 - \frac{F\omega^2}{\omega^2 - \omega_0^2 + i\omega\Gamma} \tag{5}$$

Here, ρ is the resistance per unit length of the rings measured around the circumference, ω is the frequency of incident radiation, e is the distance between layers, r is the radial dimension indicated in FIG. 2(*a*), a is the distance in the lattice from one ring to the next in the planar direction, F is the fractional area of the unit cell occupied by the interior of the split ring, Γ is the dissipation factor, and C is the capacitance associated with the gaps between the rings. The expressions for $\omega_0$ and Γ can be found by comparing the terms in Equation 5. Since the Q-factor of an individual SRR used in the experiments was measured to be greater than 600. Thus, effects due to damping are relatively small.

While the expression for the capacitance of the SRR may be complicated in the actual structure, the general form of the resonant permeability shown in Equation 5 leads to a generic dispersion curve. There is a region of propagation from zero frequency up to a lower band edge, followed by a gap, and then an upper pass band. There is a symmetry, however, between the dielectric and permeability functions in the dispersion relation $$\omega = \frac{ck}{\sqrt{\varepsilon(\omega)\mu(\omega)}},$$

where c is the velocity of light in vacuum. The gap corresponds to a region where either $\epsilon_{eff}(\omega)$ or $\mu_{eff}(\omega)$ is negative. If it is assumed that there is a resonance in $\mu_{eff}(\omega)$ as suggested by Equation 5, and that $\epsilon_{eff}(\omega)$ is positive and slowly varying, the presence of a gap in the dispersion relation implies a region of negative $\mu_{eff}(\omega)$. One cannot uniquely determine via only a simple measurement, or even the measurement of the dispersion relation itself, whether the gap is due to a resonance in the $\epsilon_{eff}(\omega)$ with reasonably constant $\mu_{eff}(\omega)$, or due to a resonance in $\mu_{eff}(\omega)$ with reasonably constant $\epsilon_{eff}(\omega)$.

Using MAFIA (MAFIA is a trademark of Computer Simulation Technologies of America, Inc., Wellesley Hills, Mass.) Release 4.0, a commercial finite-difference code, dispersion curves were generated for the periodic infinite metallic structure consisting of the split ring resonators of FIG. 1. The dispersion curves are shown in FIGs. 3(*a*)–3(*d*). There are two incident polarizations of interest: magnetic field polarized along the split ring axes ($H_{\parallel}$, FIG. 3(*a*) inset), and perpendicular to the split ring axes ($H_{\perp}$, FIG. 3(*b*) inset). In both cases, the electric field is in the plane of the rings. As shown by the curves in FIGs. (3)*a* and 3(*b*), a band gap is found in either case, although the $H_{\parallel}$ gap of FIG. 3(*a*) can be interpreted as being due to negative $\mu_{eff}(\omega)$, and the $H_{\parallel}$ gap of FIG. 3(*b*) can be interpreted as being due to a negative $\epsilon_{eff}(\omega)$. The negative permeability region for the $H_{\parallel}$ modes begins at 4.2 GHz and ends at 4.6 GHz, spanning a band of about 400 MHz. Not evident from the FIG. 3(*b*), but consistent with the model indicated in Equation 5, $\mu_{eff}(\omega)$ switches to a large negative value at the lower band edge, decreasing in magnitude (but still negative) for increasing frequency through the gap. At the upper band edge, $\mu_{eff}(\omega)=0$,and a longitudinal mode exists (not shown), identified as the magnetic plasmon mode by Pendry et al. For the dielectric gap shown in FIG. 3(*b*), the same behavior is observed, but with the roles of $\epsilon_{eff}(\omega)$ and $\mu_{eff}(\omega)$ reversed.

The insertion of a conducting wire into each unit alters the permittivity of the surrounding medium. The conducting wire is shown in FIG. 3(*c*) and 3(*d*). The combination of a conducting wire medium and a SRR medium provides the basis for the exemplary preferred left handed medium of the invention shown in FIG. 1. Since the wire structure alone is known to contribute a negative effective permittivity from $\omega$ to $\omega_p$, the consideration of the wire also helps distinguish whether the band gaps illustrated in FIGS. 3(*a*) and 3(*b*) are due to either the $\mu_{eff}(\omega)$ or $\epsilon_{eff}(\omega)$ of the SRR being negative.

In a 2-D medium composed of periodically placed conducting posts like those shown in FIGS. 3(*c*) and 3(*d*), there is a single gap in propagation up to a cutoff frequency, $\omega_p$, for modes with the electric field polarized along the axis of the posts. This onset of propagation has been identified by others with an effective plasma frequency dependent on the wire radius and spacing, with the effective dielectric function following the form $$\varepsilon_{eff}(\omega) = 1 - \frac{\omega_p^2}{\omega^2}.$$

A reduction in $\omega_p$ can be achieved by restricting the current density to thin wires, which also increases the self-inductance per unit length, L. When the conductivity of the wires is large, the plasma frequency has been shown by others to have the general form $\omega_p=(d^2L\epsilon_0)^{-1/2}$, and a wire structure can be shown to have a $\omega_p$ at microwave or lower frequencies. Combining the SRR medium having a frequency band gap due to a negative permeability, with a conducting wire medium in accordance with the invention produces a resultant left-handed medium in the region where both $\mu_{eff}(\omega)$ and $\epsilon_{eff}(\omega)$ have negative values simultaneously.

Numerical simulations were carried out that modeled a medium of parallel posts of radius 0.4 mm interleaved with a SRR medium. Electromagnetic modes were considered in which the electric field was polarized parallel to the axes of the posts, as shown in the inset of FIG. 3(*c*). The results of these simulations are shown as dashed lines in FIGS. 3(*c*) and 3(*d*). For the wire medium alone, a gap extends from zero frequency to $\omega_p$, at 13 GHz. When the wire medium is added to the SRR medium, such that the posts are placed symmetrically between SRRs, for the $H_{\parallel}$ case a pass band (the dashed line in FIG. 3(*c*) occurs within the previously forbidden band of the SRR dispersion curves of FIG. 3(*a*). The occurrence of this pass band within a previously forbidden region indicates that the negative $\epsilon_{eff}(\omega)$ for this region has combined with the negative $\mu_{eff}(\omega)$ to allow propagation, as predicted by the simulations.

By combining the ideal frequency dependence for the wire medium with Equation 5 for the permeability of SRRs, the following expression for the dispersion relation of the combined medium can be derived:

$$k^2 = \frac{(\omega^2 - \omega_p^2)}{c^2}\frac{(\omega^2 - \omega_b^2)}{(\omega^2 - \omega_0^2)} \tag{6}$$

where $\omega$ is incident frequency, $\omega_p$ is plasma frequency, $\omega_b$ is greater than $\omega_0$, and $\omega_b$ and $\omega_0$ define endpoints of a typical left handed propogation frequency band. Equation (6) shows that the range of the propagation band (k real) extends from $\omega_0$ to $\omega_b=\omega_0/\sqrt{\sqrt{1-F}}$. This was formerly the region of the gap of the SRR structure in the absence of the posts. The dispersion relation leads to a band with negative group velocity throughout, and a bandwidth that is independent of the plasma frequency for the condition $\omega_0>\omega_b$.

The behavior of the magnetic gap can be contrasted with that occurring for the $H_{\perp}$ case, which has been identified as a dielectric gap. Because H is parallel to the plane of the SRR, magnetic effects are small, and $\mu_{eff}(\omega)$ is small, positive, and slowly varying. As shown in FIG. 3(*d*), a pass band (dashed line) again occurs, but now outside of the forbidden region, and within a narrow range that ends abruptly at the band edge of the lowest propagation band. The pass band in this case occurs where the effective dielectric function of the split rings exceeds the negative dielectric function of the wire medium. As the dispersion curves calculated do not include losses, there will always be a range of pass-band frequencies, however narrow, when the resonant dielectric medium of split rings is combined with the negative dielectric medium of wires. Once again, the behavior of the dielectric gap can be described by an approximate dispersion relation:

$$k^2 = \frac{(\omega^2 - \omega_p^2)(\omega^2 - \omega_f^2)}{c^2(\omega^2 - \omega_b^2)} \tag{7}$$

where $\omega_f^2=\omega_0^2\omega_p^2/(\omega_0^2+\omega_p^2)$. The derivation of Equation 7 neglects the difference between $\omega_0$ and $\omega_b$, as $\omega_b$ does not play an essential role here, and assumes $\omega_p>>\omega_0$. The propagation band in this case extends from of to $\omega_f$ to $\omega_0$, with a bandwidth strongly dependent on the plasma frequency. As the plasma frequency is lowered, the lower edge of the propagation band lowers, increasing the overall bandwidth. The group velocity of this band is always positive. Both Equations 6 and 7 neglect medium losses (i.e., $\Gamma=0$). The contrast between the two propagation bands in the $H_{\parallel}$ and $H_{\perp}$ cases illustrates the difference between the magnetic and dielectric responses of the SRR.

SRR's of the form of FIG. 1 were fabricated using a commercially available printed circuit board. In order to test the results of the simulations, square arrays of SRRs were constructed with a lattice spacing of 8.0 mm between elements. As the magnetic flux generated by the SRR is required to return within the unit cell, the fractional area F is the critical parameter for the enhancement of the permeability.

Microwave scattering experiments were performed on the fabricated SRR medium, and the combined SRR/metal wire medium. In order to ease the required size of the structure, A two-dimensional microwave scattering chamber, described by Smith et al., *J. Opt. Soc. Am.* B, 10, 314 (1993) was utilized. The scattering chamber is made out of aluminum, with a grid pattern of holes in the top plate to allow source and probe antenna coupling. Microwave absorber medium placed around the periphery of the chamber minimized reflection back into the scattering region.

Figure 4:
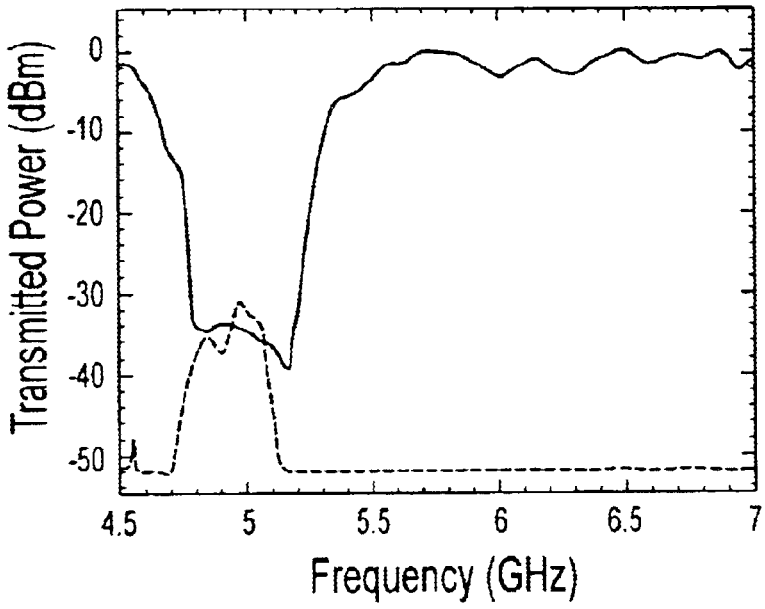
FIG. 4 is a dispersion curve for a parallel polarization in medium of the type shown in FIG. 1.

For the $H_{||}$ polarization, 17 rows of SRRs were utilized in the H direction, (8 elements deep in the propagation direction) oriented as in FIG. 3(*a*) (inset). FIG. 4 shows the results of transmission experiments on split rings alone (solid curve), and split rings with posts placed uniformly between (dashed curve). The square array of metal posts alone had a cutoff frequency of 12 GHz; the region of negative permittivity below this frequency, where the medium was opaque, attenuated the transmitted power to below the noise floor of the microwave detector (−52 dBm). When the SRR medium was added to the wire array, a pass band occurred, consistent with the propagation region indicated by the simulation (FIG. 3(*c*)).

Many other geometries are possible. Generally, the geometry of the solenoidal resonator must enclose significant amount of magnetic flux to ensure generation of solenodial current. Control or modulation of the properties or functionality of a LHM of the invention can be effected by placing nonlinear media within the split ring gaps, due to the large electric fields built up within the gaps. Similarly, magnetic media can be placed inside the SRRs at optimum positions to be effected by the strong local magnetic fields. The ability of the LHM to effect the propagation of an electromagnetic wave will depend upon the incident field amplitude, direction, polarization and length of time of application. More than one source of electromagnetic field may be introduced in order to serve as a stimulus to drive a region of nonlinear medium. Superconducting media, if used for the conductive medium forming the resonator units, may reduce microwave attenuation length due to lower losses.

Figure 5A:
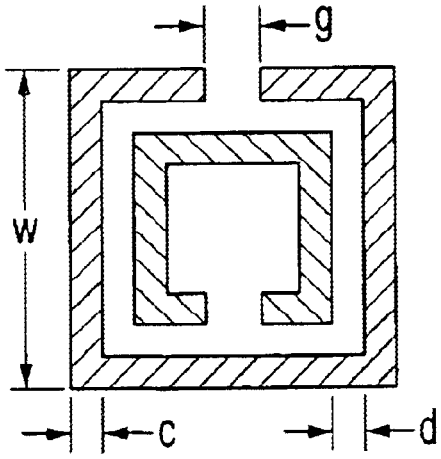
FIG. 5(*a*) illustrates a rectangular resonator.
Figure 5B:
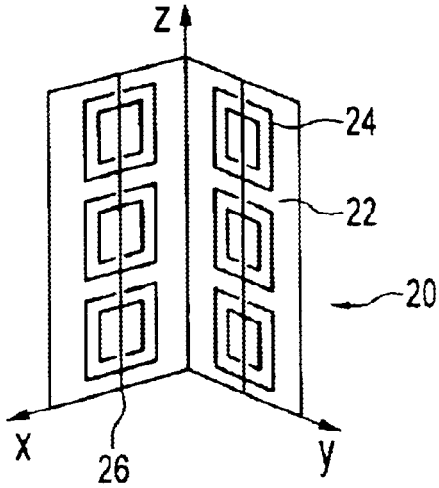

Another exemplary geometry is shown in FIGS. 5(*a*) and 5(*b*). FIG. 5(*b*) shows a left-handed unit replicable in any direction to form a left hand medium of the invention having a left-handed propagation frequency bands for waves traveling in any direction in a plane perpendicular to the wires, operable over frequencies in the 8–12 GHz band (or X-band). This geometry is a two-dimensional left-handed medium, having left-handed propagation bands that occur for only two directions of propagation. By utilizing three orthogonal sets of split rings and corresponding wires extending in all three dimensions, a three-dimensional left-handed medium can be formed. Each unit 20 in the medium is formed from a dielectric medium 22, e.g., fiberglass circuit board, with vertically arranged solenoidal resonators 24 (see FIG. 5(*a*)) on a surface of the circuit board. The resonators 24 are concentric and split, and are loosely referred to as split rings despite their rectangular shape. Conducting stripes 26 are formed on the reverse side of the circuit board, oriented so as to be centered with the split rings. Viewed from the perspective of a particular resonator in a unit, an individual wire is in line with the gaps of the resonators but in a plane behind the resonators.

The wires 26, which create negative permittivity, need not be electrically connected to that of the next unit. The effect of this is to create a propagation band that starts from zero frequency to a cut off, where a frequency band gap occurs that has negative permittivity. The frequency band gap corresponding to the split ring resonators is placed to overlap with this first gap to create a region of simultaneously negative permittivity and permeability. In the isotropic two-dimensional structure shown in FIG. 5(*b*), a left-handed propagation band occurs along the (1,0), (0,1) and (1,1) directions of incidence. Experiments and simulations have shown overlapping transmission bands for the incident microwave radiation.

Figure 6:
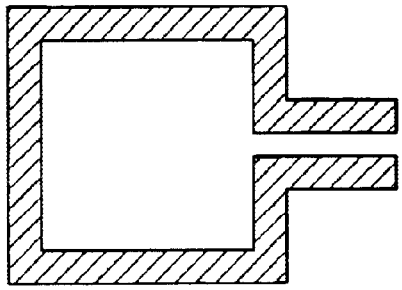
FIG. 6 illustrates a "G" resonator.
Figure 7:
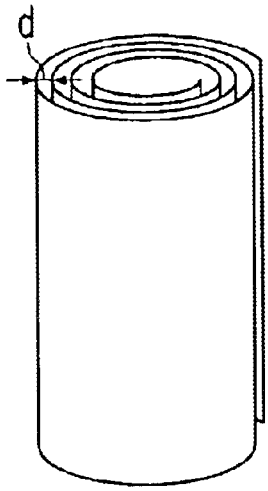
FIG. 7 illustrates one periodic "swiss roll" resonator structure.
Figure 8:
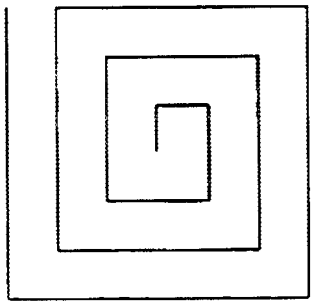
FIG. 8 illustrates one periodic spiral resonator structure.

Another examplary resonantor which meets the general criteria of enclosing significant amount of magnetic flux to ensure generation of solenodial current is shown in FIG. 6. FIG. 6 is the "G" resonator. The "G" resonator uses a single ring, as opposed to having a smaller ring enclosed by a larger ring as in the other exemplary embodiments. Nonetheless, the resonator of FIG. 6 provides the basis for another alternate composite negative permeability structure.

Utilizing the methods and the media discussed, one may design and fabricate a composite material in which the value of the refractive index may be varied from zero, over an appreciable range of values. A particularly useful value is −1. If the permittivity and permeability of the medium both have a value of −1, the medium has the unusual property that any shape or extent of the medium will have greatly reduced reflection for frequencies at which those values are achieved.

A composite sample formed from the combination of a sheet of a given thickness of a left-handed composite medium of the invention and a sheet of a given thickness of a right-handed medium may be designed to reduce overall reflected power. This reduction comes about because the phase advance in a LHM is opposite to that of a RHM, so that the composite may produce a lowered net total phase advance. A composite sample of this type which results in a significantly reduced net total phase advance of the transmitted wave is termed a conjugate sample.

As an example, a lossless RHM sheets of medium having a given index $n_1$ and a given impedance $z_1$ when combined with a LHM slab of equal length and equivalent impedance $z_2=z_1$ and equal magnitude but opposite sign of the refractive index ($n_2=-n_1$) will produce a combination sample with no reflection. This will be true at any frequency for which the previously described equalities hold, and for all angles of incidence. Matching a LHM and RHM structure over a broad frequency band requires LHM and RHM structures with equal impedances and indices-of-refraction properties equal in magnitude but opposite in sign over a given frequency band. The LHM is termed the conjugate match to the RHM.

In many cases it will be desirable to simultaneously reduce both the overall reflected power and the transmitted power from a conjugate sample. This may be accomplished by introducing adiabatically a means of absorbing the electromagnetic radiation. As an example, absorption could be introduced by increasing the resistivity of the components of the LHM adiabatically in the direction of wave propagation. Additionally, absorbing materials may introduced into the substrate medium or host medium.

As described above, Veselago concluded that the Cerenkov radiation from a charged beam traveling through a left-handed medium at speeds greater than the phase velocity of electromagnetic waves within the medium would be reversed, so as to propagated in a direction opposite to that of the charged beam. Certain devices, known as backward wave oscillators, produce radiation from charged beams. These devices must make use of particular structures periodic on the order of the wavelength of the generated electromagnetic radiation in order to create a backward traveling wave that interacts with the forward moving particle bunches. A LHM, in conjunction with suitably reflecting components, can act as an intrinsic backward wave oscillator, as charged particle bunches introduced will generate backward waves in a manner similar to periodic structures in RHM.

While specific embodiments of the present invention have been shown and described, it should be understood that other modifications, substitutions and alternatives are apparent to one of ordinary skill in the art. Such modifications, substitutions and alternatives can be made without departing from the spirit and scope of the invention, which should be determined from the appended claims.

Various features of the invention are set forth in the appended claims.

What is claimed is:

1. A medium operable to have at least one frequency band in which both effective permeability and effective permittivity are negative simultaneously, the medium comprising:

a negative permeability medium; and a negative permittivity medium spatially combined with said negative permeability medium to form the composite medium having a frequency band in which both effective permeability and effective permittivity are negative.

2. The composite left-handed material according to claim 1 wherein elements forming the negative permittivity composite medium are superconducting.

3. The medium of claim 1, wherein both the effective permittivity and the effective permeability have the value −1 at some frequency.

4. The medium of claim 1, wherein said negative permittivity medium comprises a composite medium of elements which collectively exhibit a negative permittivity over at least one band of frequencies.

5. The medium of claim 1, wherein said negative permeability medium comprises a composite medium of elements which collectively exhibit a negative permeability over at least one band of frequencies.

6. The medium of claim 1, wherein at least a portion of the medium may be modulated.

7. The medium of claim 6, wherein said at least a portion of the medium exhibits a nonlinear modulation response.

8. The medium of claim 7, wherein said at least a portion of the medium responds to an electric field.

9. The medium of claim 6, wherein said at least a portion of the medium is operable to be modulated between a left-handed and right-handed medium.

10. The medium of claim 6, wherein said at least a portion of the medium is operable to be modulated between a propagating and non-propagating medium.

11. The medium of claim 6, wherein said negative permittivity medium comprises a modulable permittivity medium spatially combined with said negative permeability medium, the modulable permittivity medium responding to one or more stimuli to be internally modulable or externally modulable between one value of a negative permittivity and another value of a negative permittivity.

12. The modulable permirtivity medium of claim 11, wherein the modulable permittivity medium transmits a selected band of frequencies at one value of modulable permittivity, and transmits another selected band of frequencies at another value of modulable permittivity.

13. The medium of claim 6, wherein said negative permittivity medium comprises a modulable permittivity medium spatially combined with said negative permeability medium, the modulable permittivity medium responding to one or more stimuli to be internally modulable or externally modulable between a negative permittivity and a positive permittivity, to form with the negative permeability, when switched to a positive permittivity, a non-propagating composite medium.

14. The medium of claim 6, wherein said negative permeability medium comprises a modulable permeability medium spatially combined with said negative permittivity medium, the modulable permeability medium responding to one or more stimuli to be internally modulable or externally modulable between one value of a negative permeability and another value of negative permeability.

15. The modulable permittivity medium of claim 14, wherein the modulable permeability medium transmits a selected band of frequencies at one value of modulable permeability, and transmits another selected band of frequencies at another value of modulable permeability.

16. The medium of claim 6, wherein said modulation comprises modulation of said permeability medium and said permeability medium modulates in response to an external stimulus.

17. The medium of claim 6, wherein said negative permeability medium comprises a modulable permeability medium spatially combined with said negative permittivity medium, the modulable permeability medium responding to one or more stimuli to be internally modulable or externally modulable between a negative permeability and a positive permeability, to form with the negative permittivity medium, when switched to a positive permeability, a non-propagating composite medium.

18. The medium of claim 6, wherein said medium includes an element to internally stimulate modulation of said permittivity medium.

19. The medium of claim 6, wherein said medium includes an element to internally stimulate modulation of said permeability medium.

20. The medium of claim 6, wherein said modulation comprises modulation of said permittivity medium and said permittivity medium modulates in response to an external stimulus.

21. The medium of claim 1, wherein said negative permittivity medium comprises a gas plasma which may be modulated.

22. A left handed composite medium having a frequency band in which both effective permeability and effective permittivity are negative simultaneously, the left handed composite medium comprising:

a supporting substrate;

a first array of elements, each element of which contributes with other elements of said first array to define a negative permeability composite medium having a negative permeability over a band of frequencies in said frequency band; and a second array of elements arranged; with said, negative permittivity composite medium by said substrate, each of said elements of said second array contributing with other elements of said second array to define a negative permittivity composite medium, the combination of said negative permeability composite medium and said negative permittivity composite medium defining a composite effective medium having a negative permittivity and a negative permeability over at least one common band of frequencies.

23. The left handed composite medium of claim 22, wherein said substrate comprises magnetostrictive medium.

24. The left handed medium of claim 22, wherein said negative permeability composite medium comprises arrays of solenoidal resonator conductive elements.

25. The left handed medium of claim 22, wherein said negative permeability composite medium comprises arrays of split ring resonator conductive elements.

26. The left handed composite medium of claim 25, wherein each said split ring conductive element comprises a split rectangular conducting resonator.

27. The left handed medium of claim 22, wherein said negative permeability composite medium compnses arrays of "G" shape conductive elements.

28. The left handed medium of claim 22, wherein said negative permeability composite medium comprises arrays of Swiss roll shape resonator conductive elements.

29. The left handed medium of claim 22, wherein said negative permeability composite medium comprises arrays of spiral shape resonator conductive elements.

30. The left handed medium of claim 22, wherein said negative permittivity composite medium comprises a low resistance conducting path arranged adjacent to a corresponding solenoidal resonator conductive element and perpendicular to the axis of the corresponding solenoidal resonator conductive element.

31. The left handed medium of claim 22, wherein eaeh said negative permittivity composite medium comprises a conducting wire arranged adjacent to a corresponding solenoidal resonator conductive element and perpendicular to the axis of the corresponding solenoidal resonator conductive element.

32. The left handed medium of claim 22 wherein said negative permittivity composite medium comprises a conducting path defined by a confined plasma arranged adjacent to a corresponding solenoidal resonator conductive element and perpendicular to the axis of the corresponding solenoidal resonator conductive element.

33. The left-handed composite medium of claim 22, wherein eaeh said negative permittivity composite medium comprises a conducting path defined by a confined plasma arranged adjacent to a corresponding solenoidal resonator conductive element.

34. The left handed composite medium of claim 22, wherein said substrate comprises a piezoelectric medium.

35. A left handed composite medium having a frequency band in which both effective permeability and effective permittivity are negative simultaneously, the left handed composite medium comprising:

a plurality of adjacent units;

one of more split conductive element resonators disposed in each said plurality of adjacent units, said split conductive element resonators defined by two concentric conductive elements of thin metal sheets with a gap between the two concentric conductive elements and a break in continuity of each of said two conductive elements; and one or more conducting wires disposed in each of said plurality of adjacent units, each wire parallel to a plane of each said split conductive element resonators disposed in each of said plurality of adjacent units; wherein said split conductive element resonators and said conducting wires having a common frequency band over which there is simultaneous negative effective permeability and permittivity.

36. The left handed medium of claim 35, wherein said concentric conductive elements comprise concentric split rectangular elements.

37. The left handed medium according to claim 35, wherein said concentric conductive elements comprise concentric split rings.

38. The left handed medium according to claim 35, wherein each of said adjacent units not on an outer edge of said medium includes two sections of orthogonal substrate, each of said two sections including one of said concentric conductive elements on a surface thereof, and each having an associated conducting wire.

39. The left handed medium according to claim 38, wherein multiple concentric conductive elements are linearly arranged in series on each of said two sections of each of said adjacent units not on an outer edge of said medium.

40. The left handed medium according to claim 39, wherein multiple concentric conductive elements are linearly arranged in series on each of said two sections of each of said adjacent units not on an outer edge of said medium.

41. The medium of claim 40, wherein means are introduced that permit adiabatic absorption along any direction of propagation within said left handed medium.

42. The medium of claim 41, wherein means are introduced that permit adiabatic absorption along any direction of propagation within left handed medium.

* * * * *

UNITED STATES PATENT AND TRADEMARK OFFICE

CERTIFICATE OF CORRECTION

PATENT NO. : 6,791,432 B2
DATED : September 14, 2004
INVENTOR(S) : Smith et al.

It is certified that error appears in the above-identified patent and that said Letters Patent is hereby corrected as shown below:

Title page,
Item [75], Inventors, after "Richard A. Shelby, San Diego, CA (US)" add
-- Willie J. Padilla, Los Alamos, NM (US); David Vier, Escondido, CA (US) --.

Signed and Sealed this

Twenty-fourth Day of January, 2006

JON W. DUDAS
*Director of the United States Patent and Trademark Office*

UNITED STATES PATENT AND TRADEMARK OFFICE

CERTIFICATE OF CORRECTION

PATENT NO. : 6,791,432 B2
DATED : September 14, 2004
INVENTOR(S) : Smith et al.

It is certified that error appears in the above-identified patent and that said Letters Patent is hereby corrected as shown below:

Column 12,
Line 32, delete "e" and insert -- ℓ --.

Column 18,
Line 47, delete "; with said," and insert -- with said --.

Column 19,
Line 16, delete "each".
Line 29, delete "each".
Line 40, delete "of" and insert -- or --.
Line 41, insert -- of -- between "each" and "said".

Column 20,
Line 7, insert -- of -- between "each" and "said".

Signed and Sealed this

Second Day of May, 2006

JON W. DUDAS
*Director of the United States Patent and Trademark Office*